US011251000B1

(12) United States Patent
Hsieh et al.

(10) Patent No.: US 11,251,000 B1
(45) Date of Patent: Feb. 15, 2022

(54) KEYBOARD

(71) Applicant: Chicony Electronics Co., Ltd., New Taipei (TW)

(72) Inventors: Chao-Chin Hsieh, New Taipei (TW); Chun-Chieh Chan, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 17/168,195

(22) Filed: Feb. 5, 2021

(30) Foreign Application Priority Data

Dec. 4, 2020 (TW) ..... 109142930

(51) Int. Cl.
*H01H 3/12* (2006.01)
*H01H 13/7065* (2006.01)

(52) U.S. Cl.
CPC ... *H01H 13/7065* (2013.01); *H01H 2231/002* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS 4,771,146 A * 9/1988 Suzuki ..... H01H 3/122 200/344
2014/0339064 A1* 11/2014 Chang ..... H01H 3/125 200/5 A

FOREIGN PATENT DOCUMENTS

TW 201916080 A 4/2019

* cited by examiner

*Primary Examiner* — Ahmed M Saeed
(74) *Attorney, Agent, or Firm* — CKC & Partners Co., LLC

(57) ABSTRACT

A keyboard includes a base plate, a keycap, and a link bar. The base plate includes a plate body and a linkage structure. The linkage structure is connected to and bended relative to the plate body. A through hole is formed at a connecting edge between the plate body and the linkage structure. The keycap is located over the base plate. The link bar includes a first rod body, a second rod body, and an engaging block. The first rod body is engaged with the keycap. The second rod body is connected to the first rod body and passes through the through hole. The engaging block is connected to an end of the second rod body and blocked by the linkage structure.

6 Claims, 10 Drawing Sheets

KEYBOARD

CROSS-REFERENCE TO RELATED APPLICATION

This application claims priority to Taiwan Application Serial Number 109142930, filed Dec. 4, 2020, which is herein incorporated by reference.

BACKGROUND

Technical Field

The present disclosure relates to a keyboard.

Description of Related Art

Currently, the keyboard is one of the indispensable input devices to enter text or numbers while using a personal computer (PC). Moreover, consumer electronic products used in daily life or large-scale processing equipment used in the industrial sector require keyswitches as input devices to be operated.

For a key on a keyboard, in order to guide the keycap to move vertically, a linking member is usually provided under the keycap of the key. For example, a conventional scissor type linking member is formed by two supporting members intersecting each other. In addition, in order to balance the force exerted by a user on a long key, a link bar is usually provided under the keycap of the long key. Therefore, regardless of the force applied to a side or a corner of the keycap, the applied force can be evenly distributed on the entire surface of the keycap.

For an existing keyboard, the link bar is limited by simply passing through the hooks on the base plate. However, when the user pulls the keycap, user can easily separate the link bar under the keycap from the base plate.

Accordingly, how to provide a keyboard to solve the aforementioned problems becomes an important issue to be solved by those in the industry.

SUMMARY

An aspect of the disclosure is to provide a keyboard that can efficiently solve the aforementioned problems.

According to an embodiment of the disclosure, a keyboard includes a base plate, a keycap, and a link bar. The base plate includes a plate body and a linkage structure. The linkage structure is connected to and bended relative to the plate body. A through hole is formed at a connecting edge between the plate body and the linkage structure. The keycap is located over the base plate. The link bar includes a first rod body, a second rod body, and an engaging block. The first rod body is engaged with the keycap. The second rod body is connected to the first rod body and passes through the through hole. The engaging block is connected to an end of the second rod body and blocked by the linkage structure.

In an embodiment of the disclosure, the through hole has a first through portion. The first through portion is located at the linkage structure and has a first width. The engaging block has a second width greater than the first width.

In an embodiment of the disclosure, the through hole further has a second through portion. The second through portion is connected to the first through portion and has a third width greater than the second width.

In an embodiment of the disclosure, the second through portion is located at the plate body and flush with the connecting edge.

In an embodiment of the disclosure, the second through portion is extended to the plate body and the linkage structure.

In an embodiment of the disclosure, the through hole further includes a third through portion. The third through portion is located at the plate body and connected to a side of the second through portion away from the first through portion. The third through portion has a fourth width smaller than the second width.

In an embodiment of the disclosure, when the keycap moves between a highest position and a lowest position relative to the base plate, the engaging block is opposite to the first through portion in an extending direction of the second rod body.

In an embodiment of the disclosure, when the keycap is located at the highest position relative to the base plate, the second rod body and the plate body form a first angle therebetween. When the second rod body and the plate body are in contact with each other and form therebtween a second angle that is greater than the first angle, the engaging block is not opposite to the first through portion in the extension direction of the second rod body.

In an embodiment of the disclosure, the keyboard further includes an elastic support member located on the plate body. The second rod body is abutted between the linkage structure and the elastic support member.

In an embodiment of the disclosure, the elastic support member is a part of a membrane circuit board disposed on the base plate.

Accordingly, in the keyboard of the present disclosure, after the link bar passes through the through hole on the base plate, an inner edge of the linkage structure of the base plate can block the engaging block of the link bar, such that the link bar can be effectively prevented from easily separating from the base plate when the keycap is pulled. By designing two through portions that can respectively block and allow the engaging block to pass through on the through hole and designing the size of the through portion that allows the engaging block to pass through, it can be ensured that the link bar will not be separated from the base plate during the normal operation stroke of the keycap, and the link bar can be assembled and disassembled only when the plate body and the base plate form a predetermined angle therebetween. In addition, by abutting the link bar between the linkage structure and the elastic support member disposed on the plate body, the stability of the link bar in the normal operation stroke of the key cap can be further increased.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
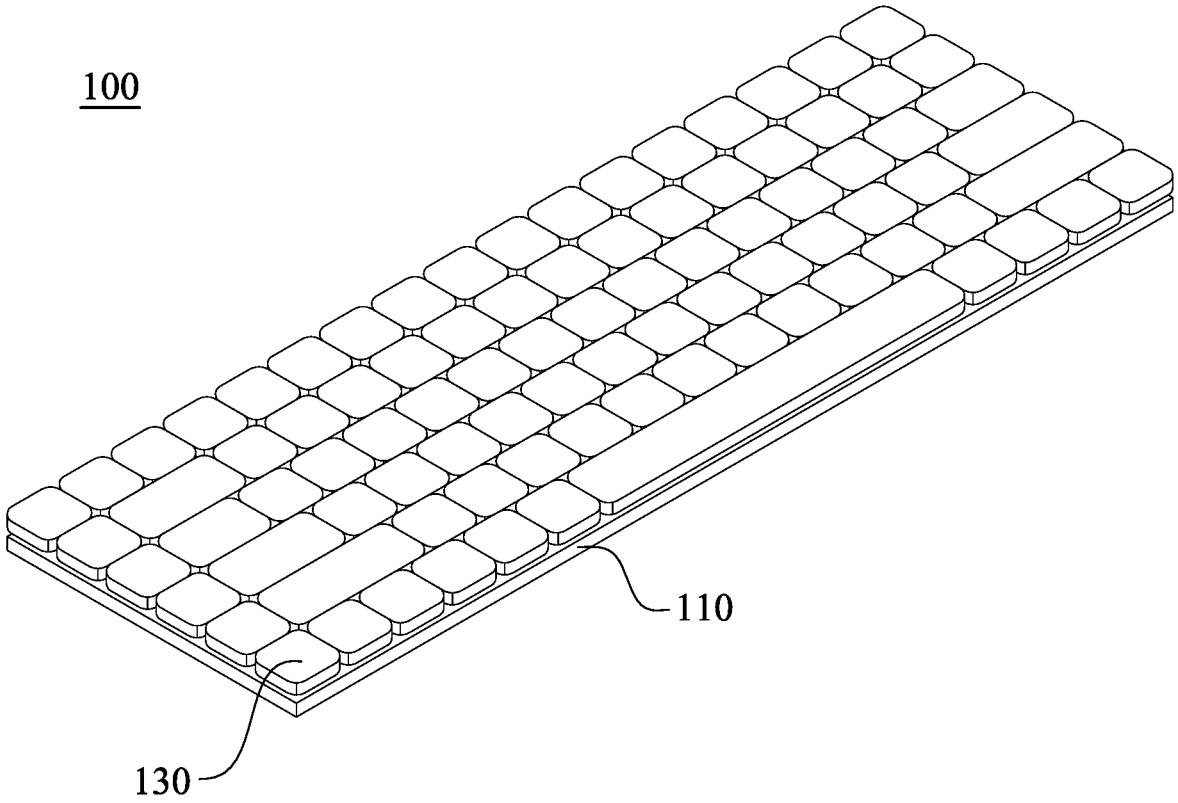
FIG. 1 is a perspective view of a keyboard according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Reference is made to FIG. 1. FIG. 1 is a perspective view of a keyboard 100 according to an embodiment of the present disclosure. As shown in FIG. 1, the keyboard 100 of the present disclosure can be an external keyboard (e.g., a keyboard with a PS/2 interface or a keyboard with a USB interface) used in a desktop computer, or can be a part of a computer system having an input device (e.g., a touch pad on a notebook computer) that is in the form of a keyswitch, but the disclosure is not limited in this regard. That is, concepts of the keyboard 100 of the present disclosure can be used in any electronic product that performs input function by pressing.

Figure 2A:
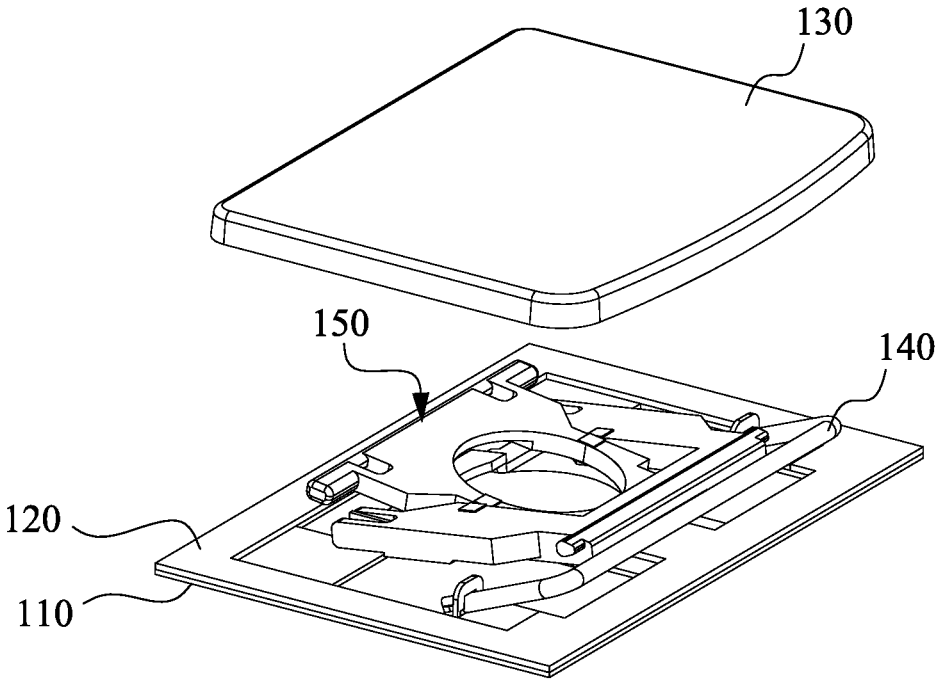
FIG. 2A is a perspective view of a keyswitch device shown in FIG. 1, in which a keycap is separated upward.
Figure 2B:
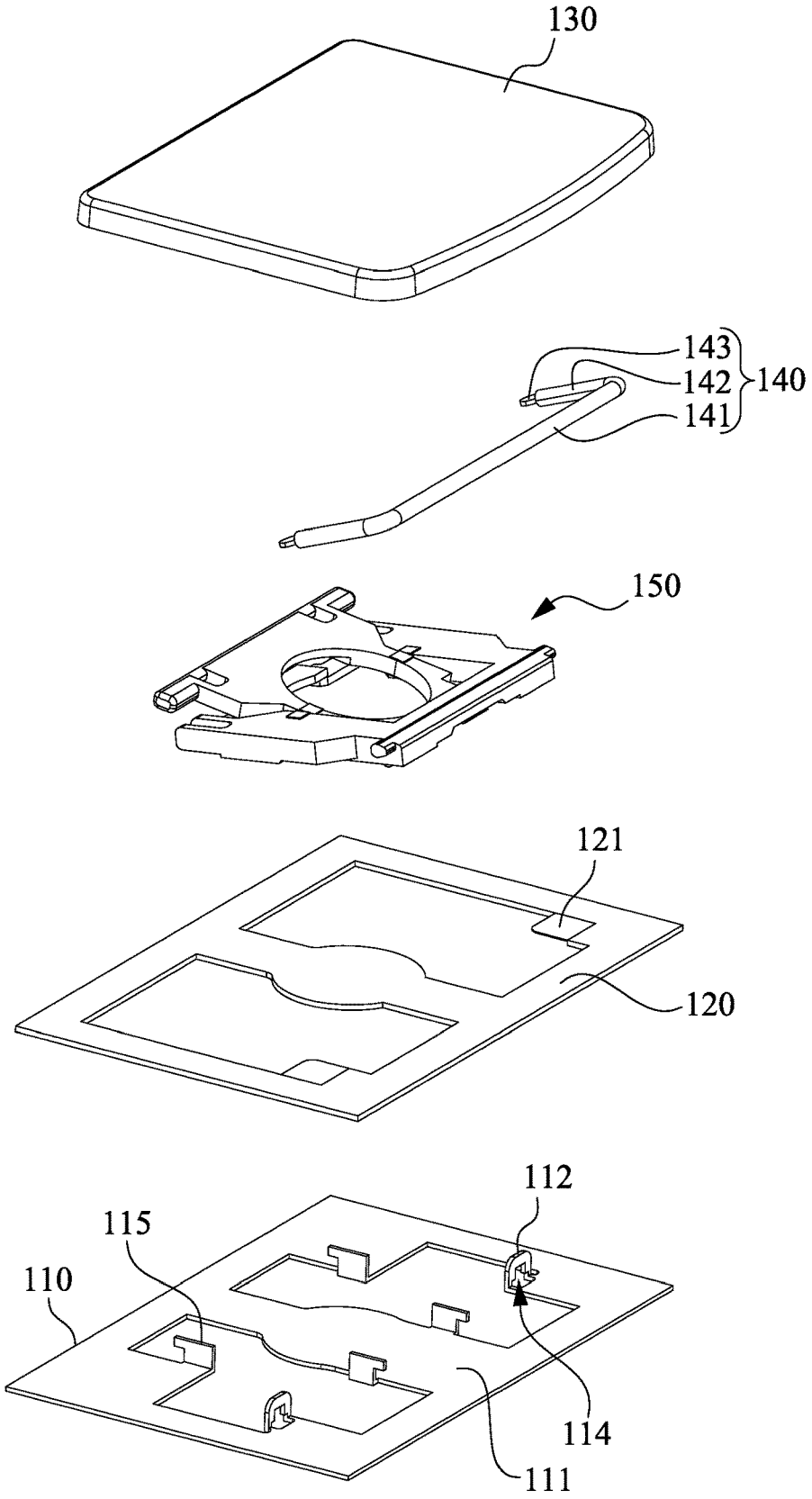
FIG. 2B is an exploded view of the keyswitch device shown in FIG. 2A.
Figure 3:
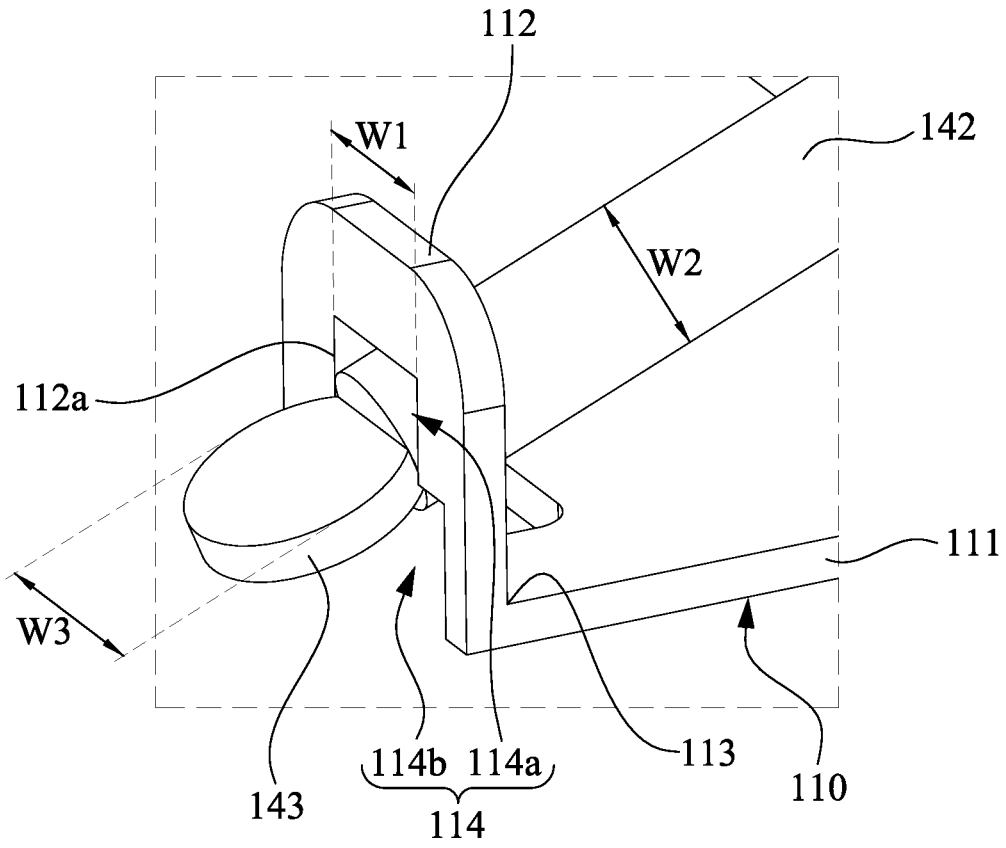
FIG. 3 is a partial perspective view of a link bar and a base plate shown in FIG. 2A.
Figure 4:
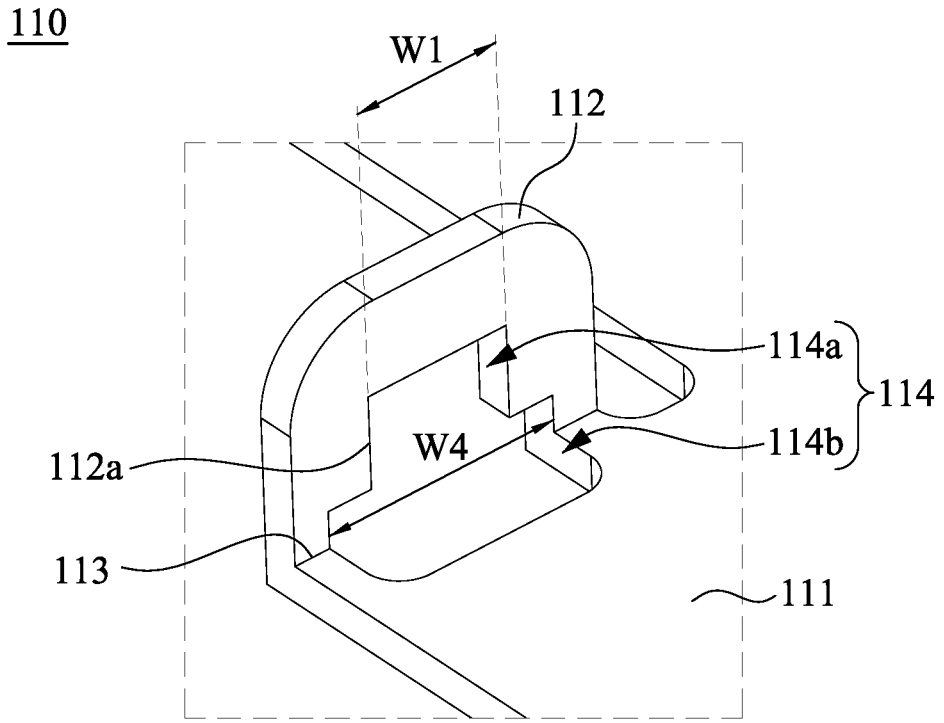
FIG. 4 is a partial perspective view of the base plate shown in FIG. 2A.

Reference is made to FIGS. 2A to 4. FIG. 2A is a perspective view of a keyswitch device shown in FIG. 1, in which a keycap 130 is separated upward. FIG. 2B is an exploded view of the keyswitch device shown in FIG. 2A. FIG. 3 is a partial perspective view of a link bar 140 and a base plate 110 shown in FIG. 2A. FIG. 4 is a partial perspective view of the base plate 110 shown in FIG. 2A. Structures and functions of components included in the keyboard 100 and connection and action relationships among these components are introduced in detail below.

As shown in FIGS. 1 and 4, in the present embodiment, the keyboard 100 includes a plurality of keyswitch devices. The keyswitch devices share a base plate 110 and a circuit board 120, and each of the keyswitch devices includes a connecting assembly 150, a keycap 130, and a link bar 140. The base plate 110 includes a plate body 111 and a plurality of engaging structures 115 connected to the plate body 111. The engaging structures 115 are hooks formed on the base plate 110 by stamping, but the disclosure is not limited in this regard. The keycap 130 is located over the base plate 110. The circuit board 120 is disposed on the base plate 110 and located between the base plate 110 and the keycap 130. Upper ends of the connecting assembly 150 and the upper end of the link bar 140 are engaged with the keycap 130 individually, and the engaging structures 115 of the base plate 110 pass through the circuit board 120 to be engaged with lower ends of the connecting assembly 150 and the lower end of the link bar 140. The connecting assembly 150 and the link bar 140 are both configured to guide the keycap 130 to move relative to the base plate 110. In addition, as shown in FIG. 2B, the link bar 140 is disposed along at least one edge of the keycap 130, so that a more balanced linkage effect can be provided to edges or corners of the keycap 130, and the applied force can be evenly distributed on the entire surface of the keycap 130.

As shown in FIGS. 2A and 2B, in the present embodiment, a scissors-like linkage assembly is used as an embodiment of the connecting assembly 150, but the disclosure is not limited in this regard. In practical applications, the connecting assembly 150 can be replaced by other structures having similar functions (i.e., moving the keycap 130 relative to the base plate 110), such as V-shaped linkage structures, A-shaped linkage structures, or linkage structures each has two parallel linkages.

In some embodiments, the keyswitch assembly of the keyboard 100 can further include a restoring member (not shown). The restoring member can be disposed between the circuit board 120 and the keycap 130. When the keycap 130 is pressed downwards by an external force, the restoring member generates a counterforce to the keycap 130 so as to provide users the tactile feeling. With the guidance of the connecting assembly 150 and the link bar 140, the pressed keycap 130 can be moved to the lowest position. When the external force applied onto the keycap 130 is released, the restoring member can provide a restoring force for returning the keycap 130 back to its highest position. The mechanism and principle of generating a trigger signal when the keyswitch device is pressed can refer to the related prior art, which will not be introduced here. In some embodiments, the restoring member can be a resilient member, such as a rubber dome, but the disclosure is not limited in this regard. In practical applications, the restoring member can also be replaced with other component having similar functions, such as a metal elastic piece, a mechanical switch, or a magnetic component.

In some embodiments, the circuit board 120 may be, for example, a printed circuit board, and a keyswitch circuit (not shown) is provided on the upper surface thereof. The bottom of the center of the restoring member can be provided with conductive material. When the keycap 130 is pressed and moved toward the base plate 110, the restoring member will deform so that the conductive material contacts the keyswitch circuit on the circuit board 120, causing the keyswitch circuit to be electrically conducted. Hence, the circuit board 120 can then generate a trigger signal corresponding to the pressed keyswitch device.

In some other embodiments, the circuit board 120 may be, for example, a membrane circuit board, but the disclosure is not limited in this regard. For example, the circuit board 120 includes a lower film layer, an upper film layer, and a spacer layer (not shown) separating the two film layers. The spacer layer has a through hole located directly under the keycap 130. The lower film layer and the upper film layer respectively include a circuit and a plurality of conductive contacts. When the keycap 130 is not pressed, the conductive contacts on the upper film layer and the circuit on the lower film layer are separated on both sides of the spacer layer and electrically separated. When the keycap 130 is pressed and moved toward the base plate 110, the keycap 130 will directly or indirectly push the upper film layer to partially enter the through hole of the spacer layer, so that the conductive contacts on the upper film layer pass through the through hole to contact the circuit of the lower film layer (that is, the trigger action). Hence, the circuit board 120 can then generate a trigger signal corresponding to the pressed keyswitch device.

As shown in FIGS. 2A to 4, in the present embodiment, the base plate 110 further includes two linkage structures 112. The linkage structures 112 are connected to and bended relative to the plate body 111. The linkage structures 112 are structures formed on the base plate 110 by stamping, but the disclosure is not limited in this regard, and the linkage structures 112 can also be provided by an injection molding process. A through hole 114 is formed at a connecting edge 113 between the plate body 111 and the linkage structure 112. In the present embodiment, the through hole 114 extended to the plate body 111 and the linkage structure 112. The link bar 140 includes a first rod body 141, two second rod bodies 142, and two engaging blocks 143. The first rod body 141 extends horizontally and is movably engaged with the structure at the bottom surface of the keycap 130 (not shown in the figure, such as a water drop hole). The two second rod bodies 142 are respectively connected to two ends of the first rod body 141 and movably pass through the two through holes 114 respectively, thereby connecting the link bar 140 to the base plate 110. In the present embodiment, orthographic projections of the two second rod bodies 142 projected on the base plate 110 and orthographic projections of the two linkage structures 112 projected on the base plate 110 are substantially perpendicular to each other, but the disclosure is not limited in this regard. In some other embodiments, a small angle may also be formed between the orthographic projections of the second rod bodies 142 and the linkage structures 112 projected on the base plate 110, so that the second rod bodies 142 laterally abut against the linkage structures 112 to prevent the link bar 140 from shaking. The link bar 140 is made of hard material to facilitate the transmission of force. In the present embodiment, the link bar 140 is made of metal material, but the disclosure is not limited in this regard. Each of the engaging blocks 143 is connected to one end of a corresponding one of the second rod bodies 142 and is stopped by the inner edge 112*a* of a corresponding one of the linkage structures 112. The inner edge 112*a* forms a part (i.e., the upper part) of the through hole 114. With the aforementioned structural configuration, the link bar 140 can be effectively prevented from being easily separated from the base plate 110 when the keycap 130 is pulled.

As shown in FIGS. 3 and 4, the through hole 114 has a first through portion 114*a*. The first through portion 114*a* is located at the linkage structure 112 and has a width W1 in a lateral direction (e.g., the direction that is parallel to the connecting edge 113). In some embodiments, as shown in FIG. 3, the second rod body 142 is cylindrical and has a width W2. In addition, the engaging block 143 is flat and has a maximum width W3. The width W2 of the second rod body 142 is smaller than the width W1 of the first through portion 114*a*, so the second rod body 142 can freely pass through the through hole 114 from the first through portion 114*a*. The maximum width W3 of the engaging block 143 is greater than the width W1 of the first through portion 114*a*. Hence, when the keycap 130 is pulled, the engaging block 143 will be stopped by the inner edge 112*a* of the linkage structure 112, and the first through portion 114*a* forms a part of the inner edge 112*a*.

As shown in FIGS. 3 and 4, the through hole 114 further has a second through portion 114*b*. The second through portion 114*b* is connected to and located under the first through portion 114*a* and has a width W4 greater than the maximum width W3 of the engaging block 143. Hence, when the link bar 140 is to be assembled to the base plate 110, the engaging block 143 of the link bar 140 can be first passed through the through hole 114 from the second through portion 114*b*, and then the first through portion 114*a* is used to stop the engaging block 143 to prevent the link bar 140 from being separated from the base plate 110.

Figure 5A:
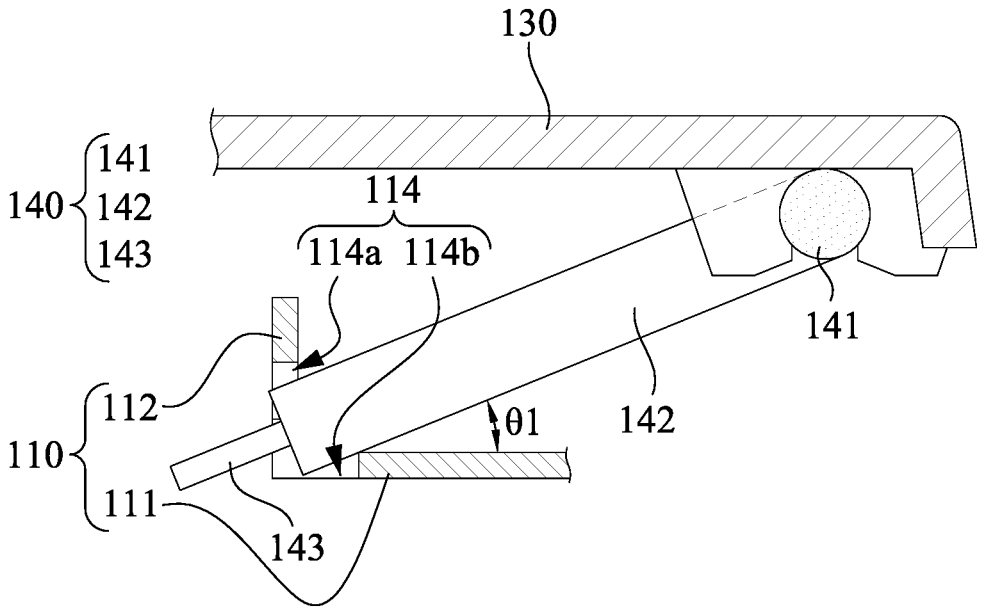
FIG. 5A is a partial cross-sectional view of certain components shown in FIG. 2A, in which the keycap is located at a highest position relative to the base plate.
Figure 5B:
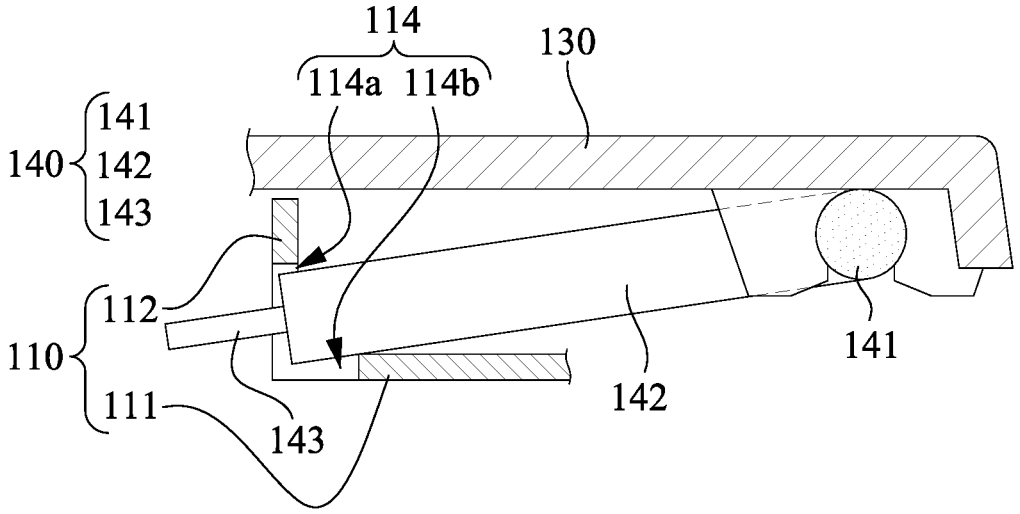
FIG. 5B is another partial cross-sectional view of the components shown in FIG. 5A, in which the keycap is located at a lowest position relative to the base plate.

In detail, reference is made to FIGS. 5A and 5B. FIG. 5A is a partial cross-sectional view of certain components shown in FIG. 2A, in which the keycap 130 is located at the highest position relative to the base plate 110. FIG. 5B is another partial cross-sectional view of the components shown in FIG. 5A, in which the keycap 130 is located at the lowest position relative to the base plate 110. As shown in FIGS. 5A and 5B, when the keycap 130 is moved to the highest position and the lowest position relative to the base plate 110 after assembled, the engaging block 143 is opposite to the first through portion 114*a* in an extending direction of the second rod body 142. In other words, the projection of the engaging block 143 projected in the extending direction of the second rod body 142 passes through the first through portion 114*a*. Therefore, during the normal operation stroke of the keycap 130, the linkage structure 112 can use the part of the inner edge 112*a* that forms the first through portion 114*a* to stop the engaging block 143, thereby achieving the purpose of preventing the link bar 140 from easily separating from the base plate 110 when the keycap 130 is pulled.

Figure 6:
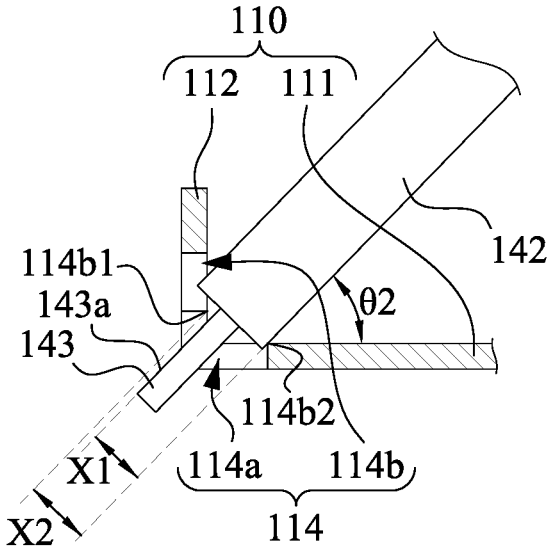
FIG. 6 is a schematic diagram showing the assembly of a link bar and the base plate according to an embodiment of the present disclosure.

Reference is made to FIG. 6. FIG. 6 is a schematic diagram showing the assembly of the link bar 140 and the base plate 110 according to an embodiment of the present disclosure. As shown in FIG. 6, the engaging block 143 which is flat has a top surface 143*a*, and the bottom end of the second rod body 142 is farthest away from the top surface 143*a* by a distance X1. In addition, an edge 114*b*1 of the second through portion 114*b* connected to the first through portion 114*a* is closest to the edge 114*b*2 of the second through portion 114*b* away from the first through portion 114*a* by a distance X2. As shown in FIG. 5A, when the keycap 130 is located at the highest position relative to the base plate 110, the second rod body 142 and the plate body 111 form an angle θ1 therebetween. In addition, as shown in FIG. 6, it can be designed that when the second rod body 142 and the plate body 111 are in contact with each other and form therebtween an angle θ2 greater than the angle θ1, the engaging block 143 is not opposed to the first through portion 114*a* in the extending direction of the second rod body 142. In other words, at this time, the projection of the engaging block 143 in the extending direction of the second rod body 142 does not pass through the first through portion 114*a*. At this time, the engaging block 143 is not stopped by the part of the inner edge 112*a* of the linkage structure that forms the first through portion 114*a* and thus can freely pass through the through hole 114. The angle θ2 can be changed by adjusting the distance X2. As a result, the second rod body 142 of the link bar 140 and the plate body 111 of the base plate 110 can be restricted to be assembled and disassembled when they form at least the angle θ2 therebetween, and the link bar 140 can be prevented from separating from the base plate 110 due to the pulling of the keycap 130 during the normal operation stroke of the keycap 130.

In some embodiments, the angle θ2 can be about 45 degrees to about 90 degrees, but the disclosure is not limited in this regard.

As shown in FIG. 4, in the present embodiment, the second through portion 114*b* is extended to the plate body 111 and the linkage structure 112, and the through hole 114 substantially has a shape with a narrow top and a wide bottom, but the disclosure is not limited in this regard.

Figure 7:
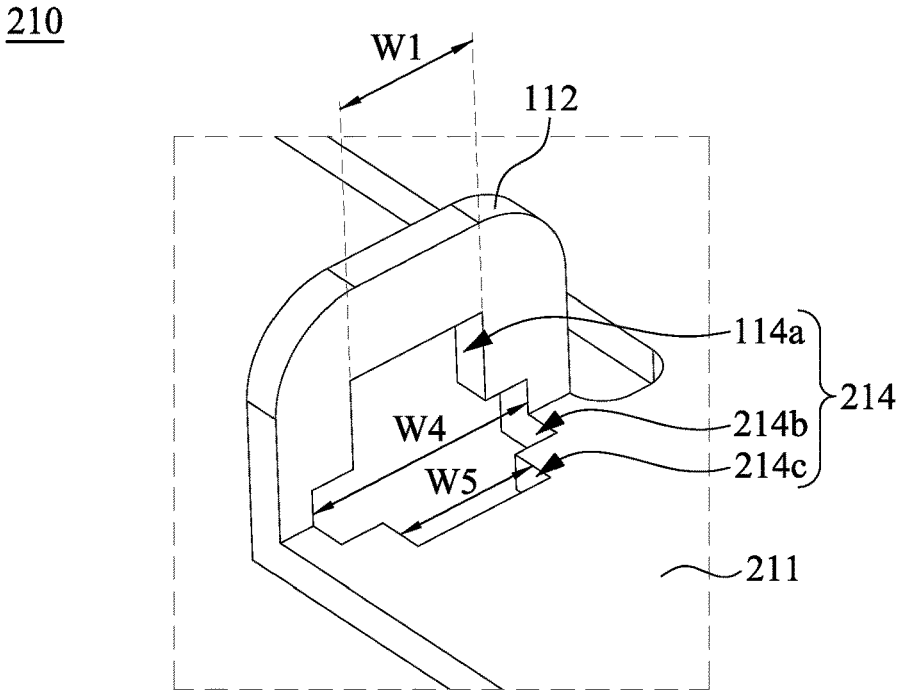
FIG. 7 is a partial schematic diagram of a base plate according to another embodiment of the present disclosure.

Reference is made to FIG. 7. FIG. 7 is a partial schematic diagram of a base plate 210 according to another embodiment of the present disclosure. As shown in FIG. 7, the second through portion 214*b* of the through hole 214 is similarly extended to the plate body 211 and the linkage structure 112. Compared with the embodiment shown in FIG. 4, the area of the second through portion 214*b* extending to the plate body 211 in the present embodiment is smaller. The through hole 214 of the present embodiment further has a third through portion 214*c*. The third through portion 214*c* is located at the plate body 211 and connected to a side of the second through portion 214*b* away from the first through portion 114*a*. The third through portion 214*c* has a width W5 that is greater than the width W2 of the second rod body 142 and smaller than the maximum width W3 of the engaging block 143. It can be seen that the third through portion 214*c* can allow the second rod body 142 to pass through freely and prevent the engaging block 143 from passing through. The through hole 214 of the present embodiment is substantially cross-shaped (i.e., being narrow in the top and bottom and wide in the center).

Figure 8:
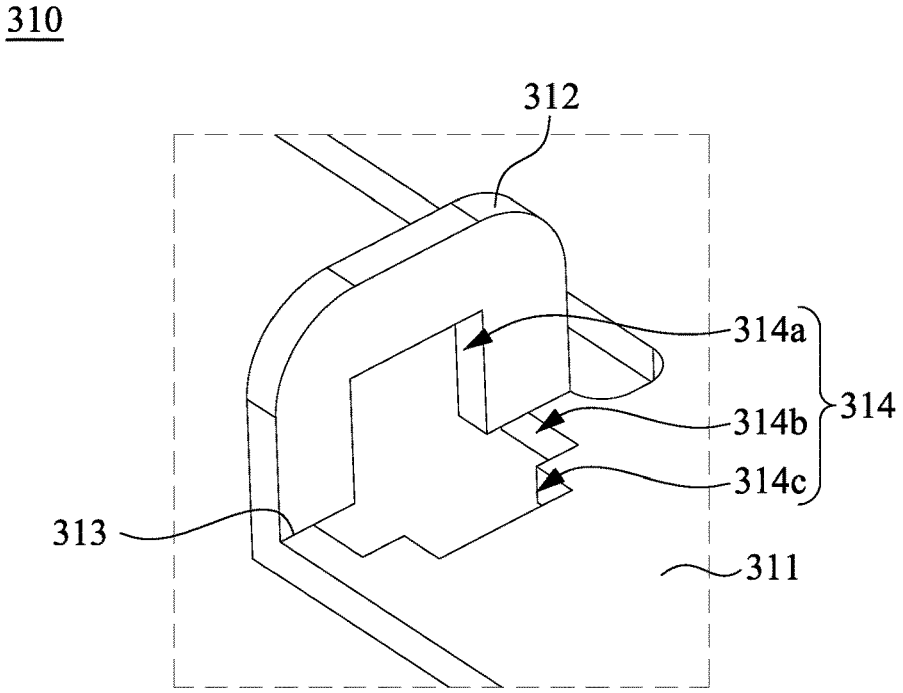
FIG. 8 is a partial schematic diagram of a base plate according to another embodiment of the present disclosure.

Reference is made to FIG. 8. FIG. 8 is a partial schematic diagram of a base plate 310 according to another embodiment of the present disclosure. As shown in FIG. 8, the through hole 314 is formed at the connecting edge 313 between the plate body 311 and the linkage structure 312. The first through portion 314*a* is located at the linkage structure 312. The second through portion 314*b* is located at the plate body 311 and flush with the connecting edge 313. The third through portion 314*c* is located at the plate body 311 and connected to a side of the second through portion 314*b* away from the first through portion 314*a*. The appearance of the through hole 314 of the present embodiment is substantially similar to the appearance of the through hole 214 of the embodiment shown in FIG. 7. Compared with the embodiment shown in FIG. 7, one difference is that the second through portion 314*b* of the present embodiment is completely formed on the plate body 311.

Figure 9:
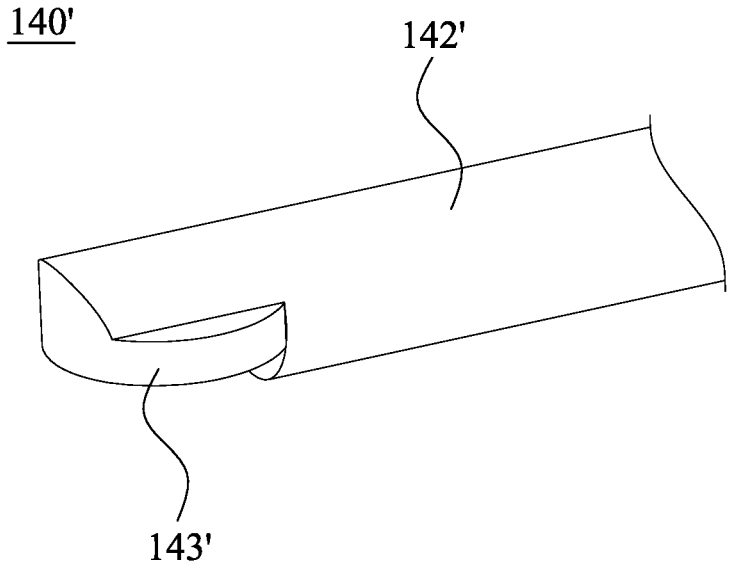
FIG. 9 is a partial schematic diagram of a link bar according to another embodiment of the present disclosure.

As shown in FIG. 3, the engaging block 143 can be formed by flattening an end of the second rod body 142 from opposite sides (e.g., the upper and lower sides), but the disclosure is not limited in this regard. Reference is made to FIG. 9. FIG. 9 is a partial schematic diagram of a link bar 140' according to another embodiment of the present disclosure. As shown in FIG. 9, the engaging block 143' can be formed by flattening an end of the second rod body 142' from a single side (e.g., the lower side). In practical applications, the aforementioned single side may also be the upper side. In the present embodiment, the link bar 140' is made of metal as an example, but the disclosure is not limited in this regard. In practical applications, the engaging block 143 can also be integrally provided when the link bar 140 is formed using rigid plastic.

Figure 10:
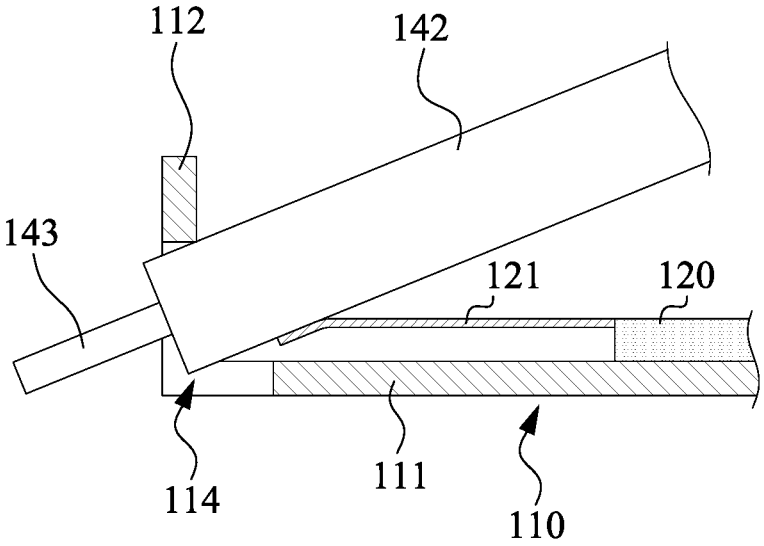
FIG. 10 is a partial cross-sectional view of certain components of the keyswitch device shown in FIG. 2A.

Reference is made to FIG. 10. FIG. 10 is a partial cross-sectional view of certain components of the keyswitch device shown in FIG. 2A. As shown in FIGS. 2A, 2B, and 10, the keyboard 100 further includes an elastic support member 121. The elastic support member 121 is located on the plate body 111. The second rod body 142 is abutted between the linkage structure 112 and the elastic support member 121. Hence, the stability of the link bar 140 in the normal operation stroke of the keycap 130 can be further improved. In the embodiment where the circuit board 120 is a membrane circuit board, the elastic support member 121 may be a part of the circuit board 120. For example, the elastic support member 121 may be a part of the upper film layer of the circuit board 120 that further extends toward the through hole 114.

According to the foregoing recitations of the embodiments of the disclosure, it can be seen that in the keyboard of the present disclosure, after the link bar passes through the through hole on the base plate, an inner edge of the linkage structure of the base plate can block the engaging block of the link bar, such that the link bar can be effectively prevented from easily separating from the base plate when the keycap is pulled. By designing two through portions that can respectively block and allow the engaging block to pass through on the through hole and designing the size of the through portion that allows the engaging block to pass through, it can be ensured that the link bar will not be separated from the base plate during the normal operation stroke of the keycap, and the link bar can be assembled and disassembled only when the plate body and the base plate form a predetermined angle therebetween. In addition, by abutting the link bar between the linkage structure and the elastic support member disposed on the plate body, the stability of the link bar in the normal operation stroke of the key cap can be further increased.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard, comprising:

a base plate comprising:

a plate body; and a linkage structure connected to the plate body, wherein a through hole is formed at a connecting edge between the plate body and the linkage structure, the through hole has a first through portion, and the first through portion is located at the linkage structure and has a first width;

a keycap located over the base plate; and a link bar comprising:

a first rod body engaged with the keycap;

a second rod body connected to the first rod body and passing through the through hole; and an engaging block connected to an end of the second rod body and blocked by the linkage structure, wherein the engaging block has a second width greater than the first width, wherein when the keycap moves between a highest position and a lowest position relative to the base plate, the engaging block is opposite to the first through portion in an extending direction of the second rod body, and wherein when the keycap is located at the highest position relative to the base plate, the second rod body and the plate body form a first angle therebetween, and when the second rod body and the plate body are in contact with each other and form therebtween a second angle that is greater than the first angle, the engaging block is not opposite to the first through portion in the extension direction of the second rod body.

2. The keyboard of claim 1, further comprising an elastic support member located on the plate body, wherein the second rod body is abutted between the linkage structure and the elastic support member.

3. The keyboard of claim 2, wherein the elastic support member is a part of a membrane circuit board disposed on the base plate.

4. A keyboard, comprising:

a base plate comprising:

a plate body; and a linkage structure connected to the plate body, wherein a through hole is formed at a connecting edge between the plate body and the linkage structure, the through hole has a first through portion and a second through portion connected to the first through portion, and the first through portion is located at the linkage structure and has a first width, wherein the second through portion is located at the plate body and flush with the connecting edge;

a keycap located over the base plate; and a link bar comprising:

a first rod body engaged with the keycap;

a second rod body connected to the first rod body and passing through the through hole; and an engaging block connected to an end of the second rod body and blocked by the linkage structure, wherein the engaging block has a second width greater than the first width, and the second through portion has a third width greater than the second width.

5. A keyboard, comprising:

a base plate comprising:

a plate body; and a linkage structure connected to the plate body, wherein a through hole is formed at a connecting edge between the plate body and the linkage structure, the through hole has a first through portion and a second through portion connected to the first through portion, and the first through portion is located at the linkage structure and has a first width, wherein the second through portion is extended to the plate body and the linkage structure;

a keycap located over the base plate; and a link bar comprising:

a first rod body engaged with the keycap;

a second rod body connected to the first rod body and passing through the through hole; and an engaging block connected to an end of the second rod body and blocked by the linkage structure, wherein the engaging block has a second width greater than the first width, and the second through portion has a third width greater than the second width.

6. A keyboard, comprising:

a base plate comprising:

a plate body; and a linkage structure connected to the plate body, wherein a through hole is formed at a connecting edge between the plate body and the linkage structure, the through hole has a first through portion, a second through portion, and a through portion, the first through portion is located at the linkage structure and has a first width, and the second through portion is connected to the first through portion, wherein the third through portion is located at the plate body and connected to a side of the second through portion away from the first through portion;

a keycap located over the base plate; and a link bar comprising:

a first rod body engaged with the keycap;

a second rod body connected to the first rod body and passing through the through hole; and an engaging block connected to an end of the second rod body and blocked by the linkage structure, wherein the engaging block has a second width greater than the first width, the second through portion has a third width greater than the second width, and the third through portion has a fourth width smaller than the second width.

* * * * *